US008328126B2

(12) United States Patent
Bruggencate

(10) Patent No.: US 8,328,126 B2
(45) Date of Patent: Dec. 11, 2012

(54) METHOD AND APPARATUS FOR PROCESSING AN ORE FEED

(75) Inventor: Kyle Alan Bruggencate, Ft. McMurray (CA)

(73) Assignee: Suncor Energy, Inc. (CA)

( * ) Notice: Subject to any disclaimer, the term of this patent is extended or adjusted under 35 U.S.C. 154(b) by 286 days.

(21) Appl. No.: 12/562,785

(22) Filed: Sep. 18, 2009

(65) Prior Publication Data

US 2010/0181394 A1 Jul. 22, 2010

Related U.S. Application Data

(60) Provisional application No. 61/098,209, filed on Sep. 18, 2008.

(51) Int. Cl.
*B02C 13/00* (2006.01)

(52) U.S. Cl. ..... 241/81; 241/236

(58) Field of Classification Search ..... 241/152.1, 241/243, 236, 159, 143, 289, 287, 81
See application file for complete search history.

(56) References Cited

U.S. PATENT DOCUMENTS

| | | | | | |
|---|---|---|---|---|---|
| 183,114 | A | * | 10/1876 | Blake | 241/135 |
| 528,974 | A | | 11/1894 | Pike | |
| 670,312 | A | * | 3/1901 | Cressonnieres | 241/159 |
| 816,763 | A | * | 4/1906 | Trask | 460/41 |
| 1,277,344 | A | * | 8/1918 | McCargar | 241/159 |
| 1,930,247 | A | | 10/1933 | McCormick | 241/17 |
| 2,606,861 | A | | 8/1952 | Eastwood | 208/55 |
| 2,661,664 | A | | 12/1953 | Baxter | 92/20 |
| 2,674,564 | A | | 4/1954 | Hermanson | 208/26 |
| 2,894,824 | A | | 7/1959 | Lanning | 422/137 |
| 3,159,562 | A | | 12/1964 | Bichard | 208/11 |
| 3,161,483 | A | | 12/1964 | Morris | 34/580 |
| 3,260,548 | A | | 7/1966 | Reichl | |
| 3,392,105 | A | | 7/1968 | Poettmann et al. | 208/11 |
| 3,402,896 | A | | 9/1968 | Daman | 241/38 |

(Continued)

FOREIGN PATENT DOCUMENTS

| | | | |
|---|---|---|---|
| CA | 841581 | 5/1970 | 196/23 |

(Continued)

OTHER PUBLICATIONS

Protest to CA 2358805 Application filed Apr. 15, 2002, 217 pages.

*Primary Examiner* — Faye Francis
(74) *Attorney, Agent, or Firm* — Kilpatrick Townsend & Stockton LLP.; M. Henry Heines

(57) ABSTRACT

A sizing roller screen apparatus and method for processing an ore feed received at an inlet is disclosed. The ore feed includes sized ore portions and oversize ore portions. The apparatus includes a roller screen having a plurality of adjacent screening rollers supported to provide interstices therebetween for permitting passage of the sized ore portions between the adjacent screening rollers, the adjacent screening rollers being operably configured to rotate to cause a first sized ore portion to pass through the interstices while the ore feed is being transported along the roller screen. The apparatus also includes a sizing roller disposed generally above an opposing one of the plurality of adjacent screening rollers, the sizing roller being operably configured to rotate to fragment at least some of the oversize ore portions passing between the sizing roller and the opposing screening roller to produce a second sized ore portion, the second sized ore portion being sized for passage between the interstices.

23 Claims, 5 Drawing Sheets

U.S. PATENT DOCUMENTS

| | | | | |
|---|---|---|---|---|
| 3,509,641 | A | 5/1970 | Smith et al. | 34/134 |
| 3,524,597 | A * | 8/1970 | Burden, Jr. et al. | 241/142 |
| 3,581,875 | A | 6/1971 | Guis | 198/782 |
| 3,808,698 | A | 5/1974 | Peters | 34/33 |
| 3,933,651 | A | 1/1976 | Erskine | 210/400 |
| 3,941,425 | A | 3/1976 | Reichl | 302/14 |
| 3,972,861 | A | 8/1976 | Gardner, Jr. et al. | 260/123.5 |
| 3,998,702 | A | 12/1976 | Opoku | 196/14.52 |
| 4,029,568 | A | 6/1977 | Pittman et al. | 208/11 |
| 4,103,972 | A | 8/1978 | Kochanowsky et al. | 299/18 |
| 4,120,776 | A | 10/1978 | Miller et al. | 208/11 |
| 4,139,646 | A | 2/1979 | Gastrock | 426/430 |
| 4,244,165 | A | 1/1981 | McElwain | 56/327.1 |
| 4,297,088 | A | 10/1981 | Akkerman | 417/378 |
| 4,424,113 | A | 1/1984 | Mitchel | 208/11 |
| 4,486,294 | A | 12/1984 | Miller et al. | 208/11 |
| 4,505,516 | A | 3/1985 | Shelton | 299/2 |
| 4,505,811 | A | 3/1985 | Griffiths et al. | 209/13 |
| 4,512,956 | A | 4/1985 | Robinson et al. | 422/270 |
| 4,538,734 | A | 9/1985 | Gill | 209/668 |
| 4,549,935 | A | 10/1985 | Tchernyak | 196/14.52 |
| 4,585,180 | A | 4/1986 | Potts | 241/186 |
| 4,658,964 | A | 4/1987 | Williams | 209/552 |
| 4,733,828 | A | 3/1988 | Potts | 241/236 |
| 4,741,444 | A | 5/1988 | Bielagus | 209/672 |
| 4,763,845 | A | 8/1988 | Guggenheimer et al. | 241/101.7 |
| 4,781,331 | A | 11/1988 | Potts | 241/236 |
| 4,795,036 | A | 1/1989 | Williams | 209/667 |
| 4,799,627 | A | 1/1989 | Potts | 241/236 |
| 4,851,123 | A | 7/1989 | Mishra | 210/609 |
| 4,994,097 | A | 2/1991 | Brouwers | 55/317 |
| 5,039,227 | A | 8/1991 | Leung et al. | 366/137 |
| 5,117,983 | A | 6/1992 | Marrs | 209/674 |
| 5,124,008 | A | 6/1992 | Rendall et al. | 204/61 |
| 5,143,598 | A | 9/1992 | Graham et al. | 208/390 |
| 5,161,744 | A | 11/1992 | Maurer et al. | 241/101.7 |
| 5,186,820 | A | 2/1993 | Schultz et al. | 209/164 |
| 5,242,580 | A | 9/1993 | Sury | 208/400 |
| 5,257,699 | A | 11/1993 | Fricker | 209/672 |
| 5,264,118 | A | 11/1993 | Cymerman et al. | 208/390 |
| 5,362,000 | A | 11/1994 | Schwelling | 241/159 |
| 5,441,206 | A | 8/1995 | Schade et al. | 241/81 |
| 5,450,966 | A | 9/1995 | Clark et al. | 209/672 |
| 5,480,566 | A | 1/1996 | Strand | 210/772 |
| 5,503,712 | A | 4/1996 | Brown | 162/55 |
| 5,589,599 | A | 12/1996 | McMullen et al. | 585/240 |
| 5,609,307 | A * | 3/1997 | Rota | 241/73 |
| 5,645,714 | A | 7/1997 | Strand et al. | 208/391 |
| 5,723,042 | A | 3/1998 | Strand et al. | 208/391 |
| 5,772,127 | A | 6/1998 | Maciejewski | 241/21 |
| 5,954,277 | A | 9/1999 | Cymerman et al. | 241/21 |
| 5,960,964 | A | 10/1999 | Austin et al. | 209/672 |
| 6,033,187 | A | 3/2000 | Addie | 417/18 |
| 6,065,607 | A | 5/2000 | Magnusson et al. | 209/665 |
| 6,076,753 | A | 6/2000 | Maciejewski et al. | 241/62 |
| 6,250,476 | B1 | 6/2001 | Kroon et al. | 209/272 |
| 6,318,560 | B2 | 11/2001 | Davis | 209/672 |
| 6,319,099 | B1 | 11/2001 | Tanoue et al. | 451/60 |
| 6,322,845 | B1 | 11/2001 | Dunlow | 426/629 |
| 6,325,863 | B1 | 12/2001 | Zamensky et al. | 134/18 |
| 6,371,305 | B1 | 4/2002 | Austin et al. | 209/672 |
| 6,390,915 | B2 | 5/2002 | Brantley et al. | 460/131 |
| 6,450,775 | B1 | 9/2002 | Hutchinson et al. | 417/198 |
| 6,460,706 | B1 | 10/2002 | Davis | 209/672 |
| 6,517,733 | B1 | 2/2003 | Carlson | 210/785 |
| 6,521,079 | B1 | 2/2003 | Roy | 156/345.12 |
| 6,585,560 | B2 | 7/2003 | Tanoue et al. | 451/5 |
| 6,648,145 | B2 | 11/2003 | Davis | 209/672 |
| 6,800,116 | B2 | 10/2004 | Stevens et al. | 95/262 |
| 6,818,058 | B2 | 11/2004 | Ronin | 106/705 |
| 6,821,060 | B2 | 11/2004 | McTurnk et al. | 406/137 |
| 7,008,966 | B2 | 3/2006 | Degeorge et al. | 518/700 |
| 7,013,937 | B2 | 3/2006 | Potts | 141/389 |
| 7,111,738 | B2 | 9/2006 | Allen, III | 209/172 |
| 7,128,375 | B2 | 10/2006 | Watson | 299/8 |
| 7,207,504 | B2 | 4/2007 | Willmot | 241/5 |
| 7,399,406 | B2 | 7/2008 | Mikula et al. | 208/390 |
| 7,556,715 | B2 | 7/2009 | Gaston et al. | 196/14.52 |
| 7,588,206 | B2 | 9/2009 | Hausman et al. | 241/235 |
| 7,677,397 | B2 | 3/2010 | Bjornson et al. | 209/672 |
| 7,893,378 | B2 | 2/2011 | Kenny | 209/576 |
| 2002/0018842 | A1 | 2/2002 | Dunlow | 426/630 |
| 2003/0089644 | A1 | 5/2003 | Hanks | 209/665 |
| 2004/0251731 | A1 | 12/2004 | Potts | 299/18 |
| 2005/0051500 | A1 | 3/2005 | Price et al. | 210/767 |
| 2005/0134102 | A1 | 6/2005 | Cymerman et al. | 299/7 |
| 2005/0161372 | A1 | 7/2005 | Colic | 208/391 |
| 2005/0173726 | A1 | 8/2005 | Potts | 257/134 |
| 2006/0091249 | A1 | 5/2006 | Potts | 241/236 |
| 2006/0226054 | A1 | 10/2006 | Bishop Jr. | 209/667 |
| 2007/0014905 | A1 | 1/2007 | Chen et al. | 426/490 |
| 2007/0095032 | A1 | 5/2007 | Nilson | 55/418 |
| 2007/0180741 | A1 | 8/2007 | Bjornson et al. | 37/403 |
| 2007/0180951 | A1 | 8/2007 | Armstrong | 75/367 |
| 2008/0047198 | A1 | 2/2008 | Mehlhose et al. | 48/210 |
| 2008/0121493 | A1 | 5/2008 | Bjornson et al. | 198/301 |
| 2008/0173572 | A1 | 7/2008 | Bjornson et al. | 208/391 |
| 2008/0197056 | A1 | 8/2008 | Kenny | 209/644 |
| 2008/0308133 | A1 | 12/2008 | Grubb et al. | 134/72 |
| 2010/0155305 | A1 | 6/2010 | Bjornson et al. | 208/390 |
| 2010/0181394 | A1 | 7/2010 | Bruggencate | 241/15 |

FOREIGN PATENT DOCUMENTS

| | | | |
|---|---|---|---|
| CA | 857305 | 12/1970 | 196/17 |
| CA | 890903 | 1/1972 | 196/17 |
| CA | 917585 | 12/1972 | 196/13 |
| CA | 918588 | 1/1973 | 196/17 |
| CA | 922655 | 3/1973 | 196/13 |
| CA | 997300 | 9/1976 | 209/46 |
| CA | 1085762 | 9/1980 | 196/24 |
| CA | 1088883 | 11/1980 | 196/24 |
| CA | 1106789 | 8/1981 | 196/24 |
| CA | 1117353 | 2/1982 | 99/24.3 |
| CA | 1126187 | 6/1982 | 196/17 |
| CA | 1132511 | 9/1982 | 241/26 |
| CA | 1137906 | 12/1982 | 196/19 |
| CA | 1153347 | 6/1983 | 241/123 |
| CA | 1163257 | 6/1984 | 241/123 |
| CA | 1193586 | 9/1985 | 241/55 |
| CA | 1214421 | 11/1986 | 196/19 |
| CA | 1231692 | 1/1988 | 241/123 |
| CA | 1266261 | 2/1990 | 241/123 |
| CA | 1309050 | 10/1992 | 196/19 |
| CA | 2116243 | 3/1993 | |
| CA | 2000984 | 4/1994 | 196/20 |
| CA | 2088227 | 4/1994 | |
| CA | 2029795 | 5/1996 | 196/17 |
| CA | 2105176 | 5/1997 | |
| CA | 2164925 | 6/1997 | |
| CA | 2294860 | 12/1998 | |
| CA | 2217623 | 4/1999 | |
| CA | 2249679 | 4/1999 | |
| CA | 2250623 | 4/1999 | |
| CA | 2220821 | 5/1999 | |
| CA | 2195604 | 11/1999 | |
| CA | 2290029 | 8/2000 | |
| CA | 2254048 | 9/2001 | |
| CA | 2358805 | 10/2001 | |
| CA | 2332207 | 2/2002 | |
| CA | 2084375 | 7/2002 | |
| CA | 2227667 | 11/2002 | |
| CA | 2352274 | 1/2003 | |
| CA | 2235938 | 4/2003 | |
| CA | 2398026 | 6/2003 | |
| CA | 2440312 | 9/2003 | |
| CA | 2498862 | 10/2003 | |
| CA | 2518040 | 12/2003 | |
| CA | 2436818 | 2/2004 | |
| CA | 2522514 | 4/2004 | |
| CA | 2441969 | 5/2004 | |
| CA | 2469326 | 5/2004 | |
| CA | 2440311 | 5/2005 | |
| CA | 2548370 | 5/2005 | |
| CA | 2548371 | 5/2005 | |
| CA | 2453697 | 6/2005 | |
| CA | 2549895 | 6/2005 | |
| CA | 2554725 | 6/2005 | |

| | | | |
|---|---|---|---|
| CA | 2558059 | | 11/2005 |
| CA | 2476194 | | 1/2006 |
| CA | 2480122 | | 3/2006 |
| CA | 2520943 | | 4/2006 |
| CA | 2486137 | | 5/2006 |
| CA | 2506398 | | 5/2006 |
| CA | 2499840 | | 9/2006 |
| CA | 2499846 | | 9/2006 |
| CA | 2552031 | | 1/2007 |
| CA | 2520821 | | 3/2007 |
| CA | 2526336 | | 5/2007 |
| CA | 2567643 | | 5/2007 |
| CA | 2567644 | | 5/2007 |
| CA | 2610124 | | 11/2007 |
| CA | 2610169 | | 11/2007 |
| DE | 2834987 | | 2/1980 |
| DE | 3936681 | | 5/1990 |
| EP | 167178 | | 11/1990 |
| EP | 493858 | B1 | 8/1992 |
| FR | 2185027 | | 12/1973 |
| GB | 1437605 | | 6/1976 |
| GB | 2010777 | | 7/1979 |
| GB | 2094662 | | 9/1982 |
| GB | 0401933-1 | | 1/2004 |
| GB | 0406802-9 | | 3/2004 |
| JP | 5096492 | | 4/1993 |
| WO | WO83/00318 | | 2/1983 |
| WO | WO83/02071 | | 6/1983 |
| WO | WO83/03062 | | 9/1983 |
| WO | WO83/03444 | | 10/1983 |
| WO | WO88/01201 | | 2/1988 |
| WO | WO96/29149 | | 9/1996 |
| WO | WO96/30629 | | 10/1996 |
| WO | WO98/58739 | | 12/1998 |
| WO | WO99/54049 | | 10/1999 |
| WO | WO00/10896 | | 3/2000 |
| WO | WO00/35585 | | 6/2000 |
| WO | WO02/092231 | | 11/2002 |
| WO | WO03/006165 | | 1/2003 |
| WO | WO03/056134 | | 10/2003 |
| WO | WO03/074394 | | 12/2003 |
| WO | WO2004/005673 | | 1/2004 |
| WO | WO2004/094061 | | 4/2004 |
| WO | WO2004/060819 | | 7/2004 |
| WO | WO2005/046874 | | 5/2005 |
| WO | WO2005/046875 | | 5/2005 |
| WO | WO2005/000454 | | 6/2005 |
| WO | WO2005/072877 | | 11/2005 |
| WO | WO2006/035209 | | 6/2006 |

* cited by examiner

METHOD AND APPARATUS FOR PROCESSING AN ORE FEED

RELATED APPLICATIONS

This application claims the benefit of U.S. provisional patent application 61/098,209 entitled "METHOD AND APPARATUS FOR PROCESSING AN ORE FEED", filed on Sep. 18, 2008 and incorporated herein by reference in its entirety.

BACKGROUND OF THE INVENTION

1. Field of Invention

This invention relates generally to processing of ore and more particularly to processing excavated ore including sized ore portions and oversize ore portions.

2. Description of Related Art

Surface mining operations are generally employed to excavate an ore deposit that is found near the surface. Such ore deposits are usually covered by an overburden of rock, soil, and/or plant matter, which may be removed prior to commencing mining operations. The remaining ore deposit may then be excavated and transported to a plant for processing to remove commercially useful products. The ore deposit may comprise an oil sand deposit from which hydrocarbon products may be extracted, for example.

In general, excavated ore includes sized ore portions having a size suitable for processing and oversize ore portions that are too large for processing. The oversize ore portions may be discarded and/or crushed to produce sized ore.

In the example of an oil sand ore deposit, such as the Northern Alberta oil sands, the ore deposit comprises about 70 to about 90 percent by weight of mineral solids including sand and clay, about 1 to about 10 percent by weight of water, and a bitumen or oil film. The bitumen may be present in amounts ranging from a trace amount up to as much as 20 percent by weight. Due to the highly viscous nature of bitumen, when excavated some of the ore may remain as clumps of oversize ore that requires sizing to produce a sized ore feed suitable for processing. Due to the northerly geographic location of many oil sands deposits, the ore may also be frozen making sizing of the ore more difficult. Such processing may involve adding water to the ore feed to produce an oil sand slurry, for example.

SUMMARY OF THE INVENTION

In accordance with one aspect of the invention there is provided a sizing roller screen apparatus for processing an ore feed received at an inlet, the ore feed including sized ore portions and oversize ore portions. The apparatus includes a roller screen having a plurality of adjacent screening rollers supported to provide interstices therebetween for permitting passage of the sized ore portions between the adjacent screening rollers, the adjacent screening rollers being operably configured to rotate to cause a first sized ore portion to pass through the interstices while the ore feed is being transported along the roller screen. The apparatus also includes a sizing roller disposed generally above an opposing one of the plurality of adjacent screening rollers, the sizing roller being operably configured to rotate to fragment at least some of the oversize ore portions passing between the sizing roller and the opposing screening roller to produce a second sized ore portion, the second sized ore portion being sized for passage between the interstices.

At least some of the screening rollers may include a plurality of spaced apart generally circular plates supported on a shaft, the plates arranged along the shaft to intermesh with spaced apart plates of an adjacent screening roller to provide the interstices.

The sizing roller may include a plurality of generally circular spaced apart plates supported on a shaft, the plates arranged along the shaft to intermesh with spaced apart plates of the opposing screening roller.

The opposing screening roller may be spaced apart from the adjacent screening rollers and the roller screen may further include a plurality of static plates extending between the opposing screening roller and an adjacent screening roller and intermeshing therewith, the static plates being sufficiently spaced apart to permit the sized ore portions to pass between the static plates.

The sizing roller may define an outer working surface that is sufficiently spaced apart from an outer working surface of the opposing screening roller to permit at least some of the oversized ore portions to be fragmented to produce the second sized ore portion.

The outer working surface of the sizing roller may include a wear resistant overlay for reducing abrasion of the sizing roller by the ore feed.

The outer working surface of the sizing roller may be spaced apart from the outer working surface of the opposing screening roller in proportion to a spacing between outer working surfaces of the plurality of adjacent screening rollers.

The outer working surface of the sizing roller may be spaced apart from the outer working surface of the opposing screening roller by about 50 mm to about 60 mm.

The outer working surface of the sizing roller may include first engagement provisions for engaging the oversized ore portion and forcing the oversized ore portion against the outer working surface of the one of the plurality of adjacent screening rollers to cause the oversized ore portion to be fragmented to produce the second sized ore portion.

The outer working surface of the opposing screening roller may include second engagement provisions for engaging the oversized ore portion and forcing the oversized ore portion against the outer working surface of the sizing roller to cause the oversized ore portion to be fragmented to produce the second sized ore portion.

The first engagement provisions and the second engagement provisions may include respective first and second engagement features that intermesh with each other to fragment the oversized ore portion.

The sizing roller may include a compliant mounting operably configured to permit the sizing roller to be displaced away from the opposing screening roller when oversize ore that resists fragmentation is passed between the sizing roller and the opposing screening roller.

The adjacent screening rollers may be supported in a first frame and the sizing roller may be mounted in a second frame disposed above the first frame, and the compliant mounting may include a pivot between the first and second frames, the pivot being operably configured to permit the second frame to displace away from the opposing screening roller.

The roller screen may include a discharge outlet located distally along the roller screen from the inlet, the outlet being operably configured to discharge the oversize ore that resists fragmentation.

The apparatus may include a comminutor located to receive the oversize ore from the outlet, the comminutor being operably configured to fragment the oversize ore to provide a third sized ore portion.

The apparatus may include a variable speed drive coupled to each of the adjacent screening rollers and the sizing roller, the variable speed drive being operable to permit configuration of respective rotational speeds of each of the rollers for processing the ore feed.

The ore feed may include a bitumen portion, and the apparatus may further include at least one nozzle disposed to spray heated water onto the ore feed to cause the bitumen portion to become less viscous thereby aiding in the processing of the ore feed.

The at least one nozzle may include a plurality of nozzles located along an entire length of the roller screen and operably configured to spray heated water onto the ore feed as the ore feed moves along the roller screen.

The roller screen may be disposed above a slurry vessel operable to produce a bitumen ore slurry of the sized ore that passes through the roller screen.

The opposing screening roller may include a generally centrally located one of the plurality of adjacent screening rollers.

The plurality of adjacent screening rollers may include first, second, third, fourth and fifth adjacent screening rollers, and the opposing screening roller may be the third adjacent roller.

In accordance with another aspect of the invention there is provided a method for processing an ore feed, the ore feed including sized ore portions and oversize ore portions. The method involves receiving the ore feed at an inlet of a roller screen having a plurality of adjacent screening rollers supported to provide interstices therebetween for permitting passage of the sized ore portions between the adjacent screening rollers. The method also involves causing the adjacent sizing rollers to rotate to cause a first sized ore portion to pass through the interstices while the ore feed is being transported along the roller screen to a sizing roller disposed generally above an opposing one of the plurality of adjacent screening rollers. The method further involves causing the sizing roller to rotate to fragment at least some of the oversize ore portions passing between the sizing roller and the opposing screening roller to produce a second sized ore portion, the second sized ore portion being sized for passage between the interstices.

Receiving the ore feed may involve receiving an ore feed including bitumen.

Receiving the ore feed may involve receiving an ore feed at a roller screen disposed above a slurry vessel operable to produce a bitumen ore slurry of the sized ore that passes through the roller screen.

Causing the sizing roller to rotate to fragment at least some of the oversize ore portions may involve causing first engagement features on the sizing roller to engage the oversized ore portion and force the oversized ore portion against an outer working surface of the opposing screening roller.

Causing the sizing roller to rotate to fragment at least some of the oversize ore portions may involve causing second engagement features on the outer working surface of the opposing screening roller to engage the oversized ore portion between the first and second engagement features to cause the oversized ore portion to be fragmented between the sizing roller and the opposing screening roller.

The method may involve discharging the oversize ore that resists fragmentation at an oversize discharge outlet located distally from the inlet along the roller screen.

The method may involve receiving the oversize ore from the outlet at a comminutor operably configured to fragment the oversized ore portions to provide a third sized ore portion.

The method may involve configuring a variable speed drive coupled to each of the adjacent screening rollers and the sizing roller to adjust respective rotational speeds of each of the rollers for processing the ore feed.

The method may involve causing at least one nozzles to spray heated water onto the ore feed to cause a bitumen portion of the ore feed to become less viscous thereby aiding in the processing of the ore feed.

Causing the at least one nozzle to spray heated water onto the ore feed may involve causing a plurality of nozzles to spray heated water onto the ore feed along an entire length of the roller screen.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

Figure 1:
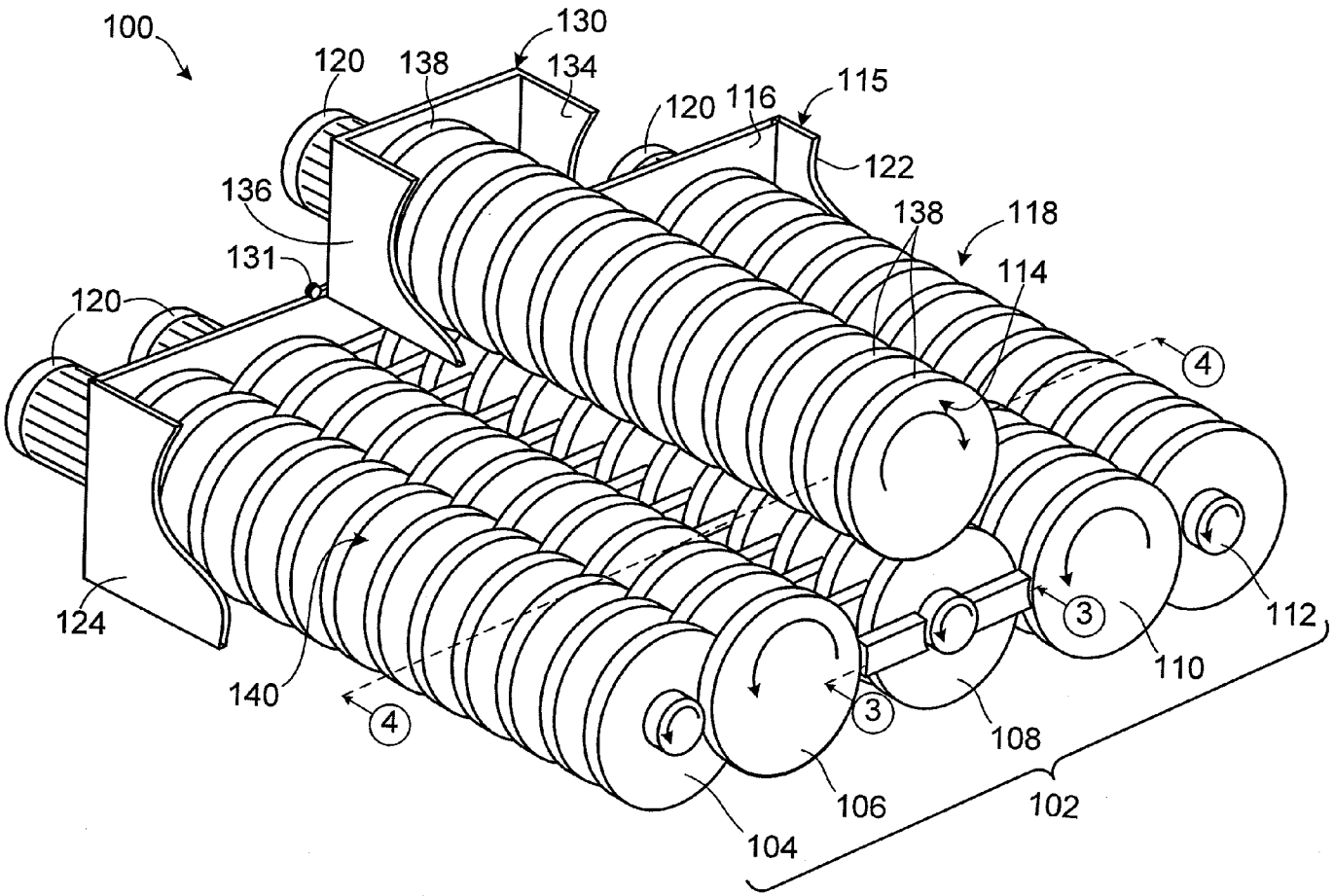
FIG. 1 is a partially cut away perspective view of an apparatus for processing an ore feed in accordance with a first embodiment of the invention.

Referring to FIG. 1, a sizing roller screen apparatus for processing an ore feed according to a first embodiment of the invention is shown generally at 100. The apparatus 100 includes a roller screen 102 having a plurality of adjacent screening rollers 104, 106, 108, 110, and 112.

The apparatus 100 has an inlet 118 for receiving the ore feed. In the embodiment shown the ore feed is received at the roller 112. The ore feed may be excavated ore from a ore deposit, such as a bitumen ore deposit, and generally includes sized ore portions and oversize ore portions. The excavated ore may be pre-sized proximate the mine face and transported to the apparatus 100 along a conveyor belt. The pre-sized ore may also have metal or other detritus removed that could cause damage to the apparatus 100. In the example of bitumen ore, the pre-sized ore may include sand and other fine constituents, rocks, and chunks of agglomerated bitumen, sand and rock in sizes less than about 400 mm. In general it is desired to process the ore to produce ore for further processing that is sized to be no larger than a certain maximum size (for example, a 50 mm nominal size).

Figure 2:
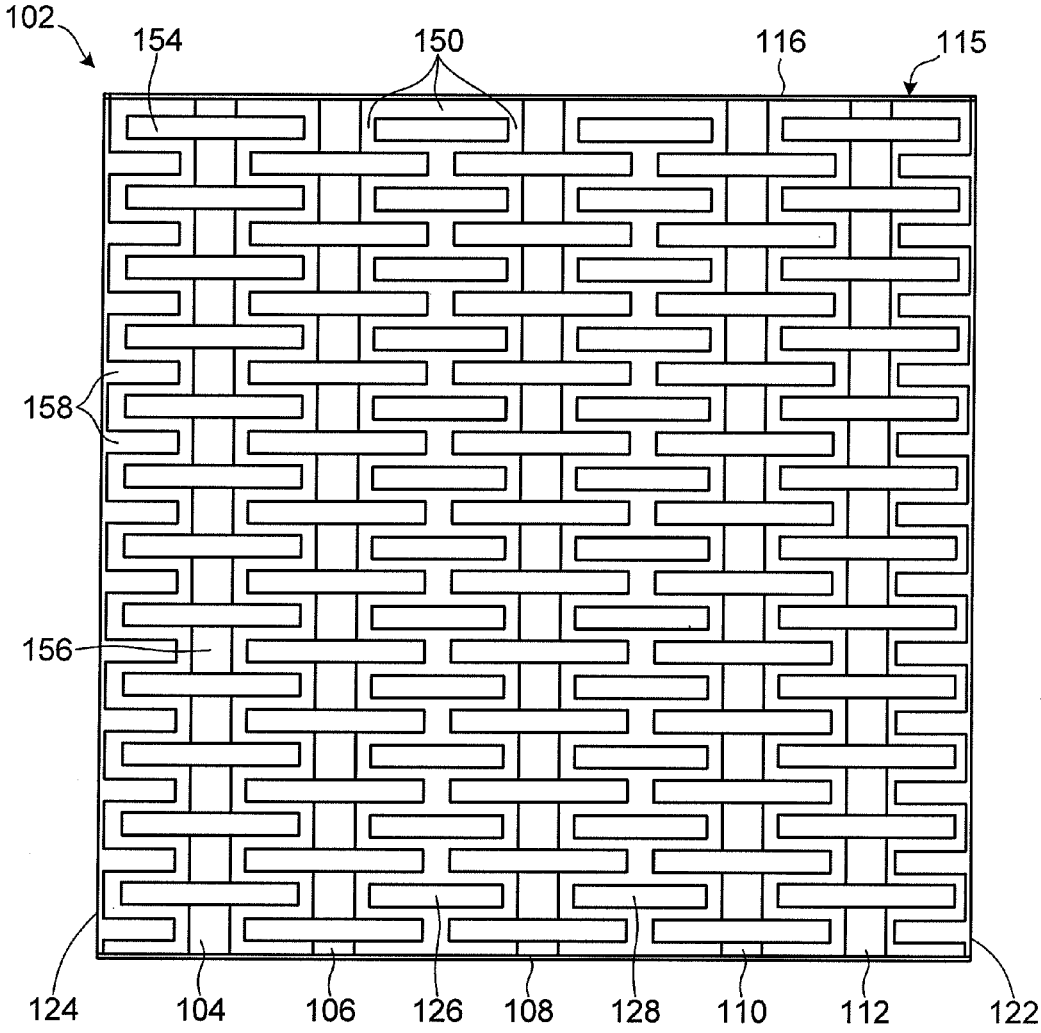
FIG. 2 is a plan view of the apparatus shown in FIG. 1.

The adjacent screening rollers 104-112 are supported by a first sidewall 116 to provide interstices therebetween. The screening rollers 104-112 of the roller screen 102 are shown in plan view in FIG. 2. Referring to FIG. 2, the interstices between the adjacent rollers 104 to 112 of the roller screen 102 are shown at 150. In general the size of the interstices 150 is selected to pass sized ore portions of a nominal passing size (e.g. about 50 mm to about 60 mm, as in the example of the bitumen ore above).

Referring back to FIG. 1, the apparatus 100 also includes a sizing roller 114 disposed generally above an opposing one of the plurality of adjacent rollers in the roller screen 102 (in this case above the roller 108, which in the embodiment shown is centrally located with respect to the screening rollers 104-112). In other embodiments, the sizing roller 114 may be located above one of the other adjacent screening rollers 104, 106, 110, or 112.

The apparatus 100 is operably configured to cause the plurality of adjacent screening rollers 104-112 to rotate to cause a first sized ore portion to pass through the interstices 150 while the ore feed is transported along the roller screen toward the sizing roller 114. In this embodiment, the apparatus 100 includes a motor 120 coupled to each of the respective adjacent screening rollers 104-112 and the sizing roller 114, for imparting a rotational drive to the rollers in the direction indicated by the arrows in FIG. 1. The apparatus 100 generally receives an ore feed at the inlet 118 and transports the ore feed along the adjacent screening rollers 112, 110, 108, 106, and 104, to a discharge outlet 140, where unbreakable oversize ore portions are discharged or further processed (as disclosed later herein).

The sizing roller 114 is coupled to the motor 120, which provides a driving force for causing the roller to rotate to fragment at least some of the oversize ore portions between the sizing roller and the roller 108 to produce a second sized ore portion. The second sized ore portion is sized for passage between the interstices 150.

In the embodiment shown, the rollers 104-112 are supported in a frame 115 having a first sidewall 116, a first end wall 122 at the inlet 118, and a second end wall 124 proximate the roller 104. The first and second end walls 122 and 124 are shown partially cut away in FIG. 1. The first and second end walls 122 and 124 are shown in top view in FIG. 2, in which the frame 115 and a second sidewall 152 are also shown.

Figure 3:
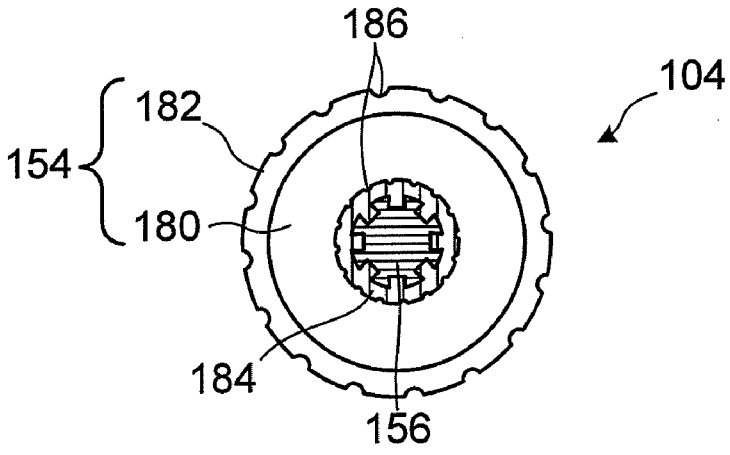
FIG. 3 is a cross sectional view of a circular plate taken along the line 3-3 in FIG. 1.

In the embodiment shown in FIG. 1 and FIG. 2, the screening rollers 104-112 each include a plurality of spaced apart generally circular plates 154 supported on a shaft 156. The plates 154 define respective working surfaces of each of the rollers 104-112. The roller 104 is shown in cross-sectional view in FIG. 3. Referring to FIG. 3, each of the generally circular plates 154 includes a body portion 180 supported on the shaft 156. The body portion 180 further includes a first wear resistant overlay 182. In the embodiment shown, the shaft 156 includes a second wear resistant overlay 184. The first and second wear resistant overlays 182 and 184 together define a working surface of the respective rollers 104-112.

In the embodiment shown in FIG. 3, the overlays 182 and 184 each have scalloped engagement features 186 to facilitate engagement of portions of the ore feed, but in other embodiments the overlays may have a variety of otherwise shaped engagement features. The engagement features act as means for engaging the ore. The body portion 180 may comprise mild steel, while the wear resistant overlays 182 and 184 may comprise hardened steel or cast white iron, for example. The wear resistant overlays 182 and 184 are selected to resist abrasion of the working surfaces by the ore feed. The shaft 156 is coupled to the motor 120, either directly or through a gearbox, for driving the roller 104 (or rollers 106-112).

Referring back to FIG. 2, the first and second end walls 122 and 124 may each additionally include a plurality of static plates 158, extending between the circular plates 154 and intermeshing therewith. In the embodiment shown in FIG. 1 and FIG. 2, the rollers 106 and 110 are spaced apart from the roller 108 and a further plurality of intermeshing static plates 126 and 128 extend between the circular plates 154 of the adjacent screening rollers 106 and 108, and 106 and 110, and therewith. The static plates permit the sized ore to pass while preventing oversize ore portions from passing between the static plates.

Referring back to FIG. 1, the sizing roller 114 is supported by a frame 130 having a third sidewall 132, a fourth sidewall (not shown) and end walls 134 and 136. In the embodiment shown the sizing roller 114 is compliantly mounted to permit the roller to displace upwardly to allow passage of unbreakable oversize ore portions, thereby avoiding damage to the roller. In the embodiment shown, the frame 130 includes a pivot wheel 131 for pivotably mounting the frame 130 on the frame 115. Similar pivot wheels are also included on the fourth sidewall (not shown). The pivot wheel 131 permits the frame 130 and sizing roller 114 to be pivoted upwardly to allow an unbreakable oversize ore portion to pass through between the rollers 114 and 108. Alternatively, the sizing roller 114 may be compliantly mounted on a sprung frame that urges the sizing roller 114 toward the roller 108 and provides a pre-determined compression force and permits movement away from the roller 108 when such unbreakable oversize ore portions pass between the rollers.

Figure 4:
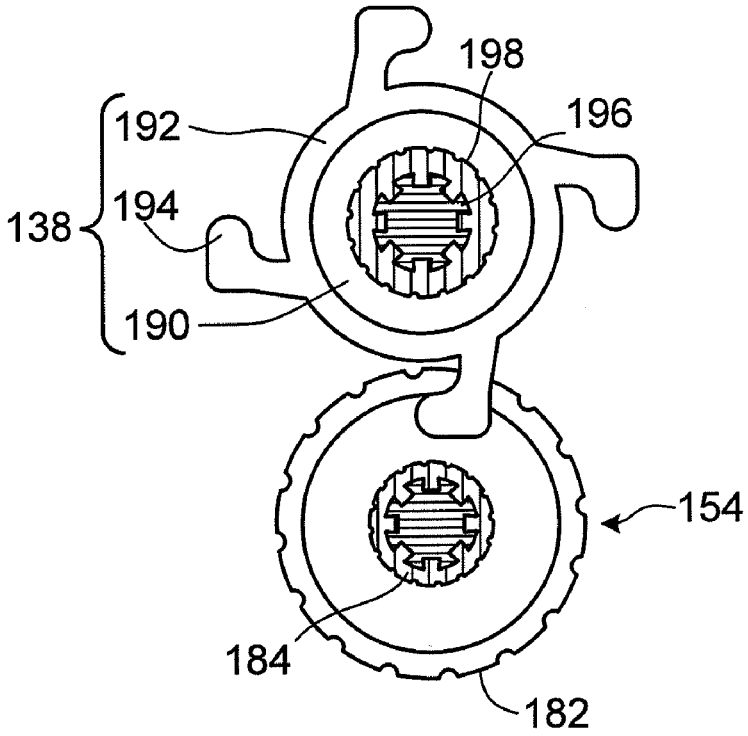
FIG. 4 is a cross sectional view of a pair of opposing circular plates taken along the line 4-4 in FIG. 1.

The sizing roller 114 also includes a plurality of spaced apart generally circular plates 138 defining a working surface. One of the circular plates 138 is shown in cross-sectional detail in FIG. 4. The intermeshing circular plate 154 of the roller 108 is also shown in FIG. 4. Referring to FIG. 4, the circular plate 138 includes a body portion 190 supported on a shaft 196. The body portion 190 has a third wear resistant overlay 192. In this embodiment the third wear resistant overlay 192 further includes a plurality of hooked engagement features 194 that act as means for engaging the oversize ore portions and fragmenting the oversize portions against the working surfaces of the plates 154. The shaft 196 includes a fourth wear resistant overlay 198. In this embodiment, the third and fourth wear resistant overlays 192 and 198 make up the outer working surface of the sizing roller 114. Fragmentation of the ore generally occurs between the wear resistant overlays 192, 198, 182 and 184 of the respective interleaved circular plates.

In certain embodiments, the outer working surface of the sizing roller 114 may be spaced apart from the outer working surface of the opposing screening roller 108 in proportion to a spacing between outer working surfaces of the plurality of adjacent screening rollers. For example, the outer working surface of the sizing roller 114 may be spaced apart from the outer working surface of the opposing screening roller 108 by about 50 mm to about 60 mm.

Figure 5:
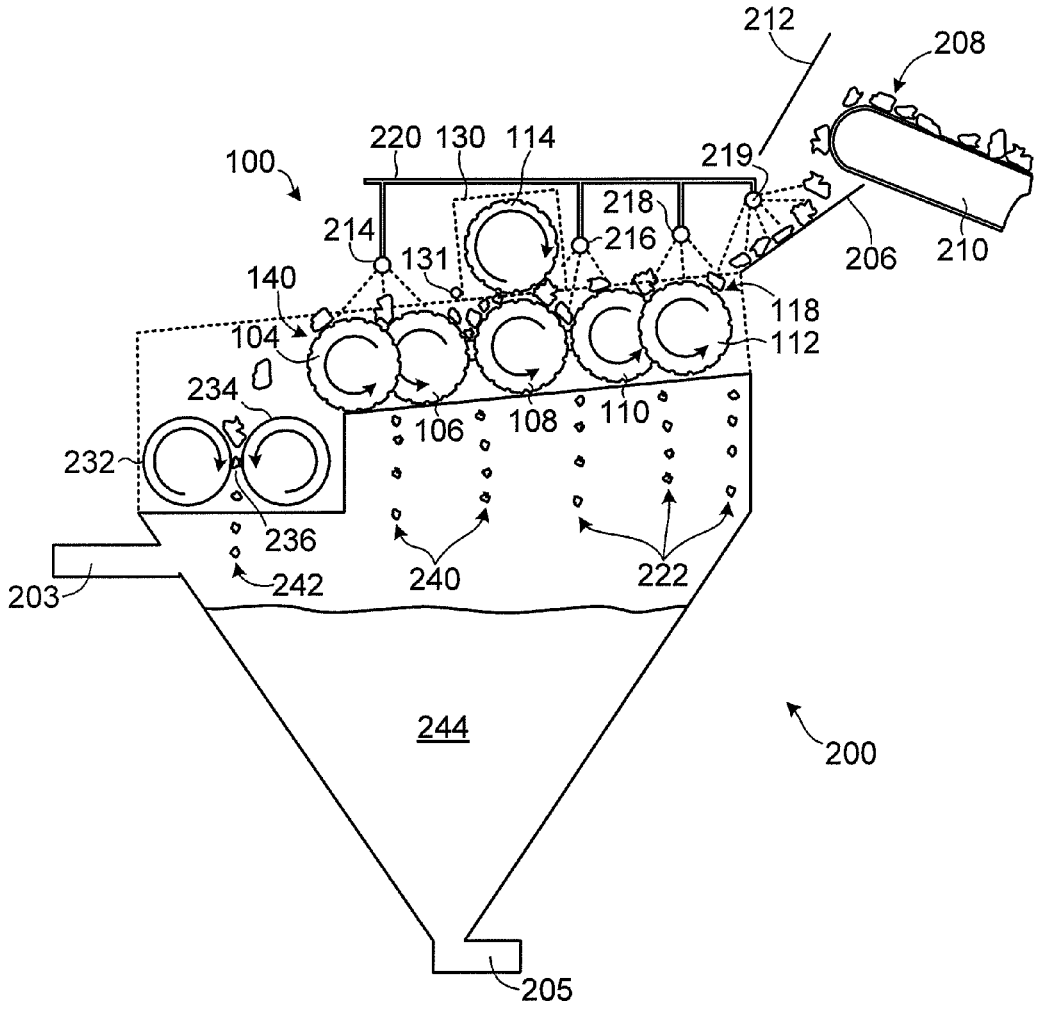
FIG. 5 is a side schematic view of a slurry apparatus incorporating the apparatus shown in FIG. 1.

Referring to FIG. 5, in one embodiment the apparatus 100 is used to size ore for producing a slurry in a slurry apparatus shown generally at 200. The slurry apparatus 200 includes a slurry vessel 202. The slurry vessel 202 has an upper opening 204 and is also provided with a solvent inlet 203, which is in communication with a solvent source (not shown), and an outlet 205. The apparatus 100 is located above the opening 204 of the slurry vessel 202.

The inlet 118 of the sizing roller screen apparatus 100 is in communication with a slope sheet 206 for receiving an ore feed 208 from a transfer conveyor 210. In this embodiment a batter board 212 is also provided at the inlet 118 to deflect ore portions and spread the ore laterally across the inlet to provide a generally uniform ore feed across the roller 112. The batter board 212 may be curved or otherwise shaped to deflect some ore portions to either side of the inlet 118 to produce a uniform ore feed. The apparatus 100 also includes nozzles 214, 216, 218, and 219, which are disposed to spray solvent on the ore feed. The nozzles 214, 216, and 218, are in communication with a fluid supply conduit for receiving solvent from a pressurized solvent source (not shown).

In the embodiment shown in FIG. 5, the slurry apparatus 200 also includes a comminutor 230 disposed to receive oversized ore portions from the discharge outlet 140. The comminutor 230 includes a pair of rollers 232, spaced apart to provide a gap 236 between the rollers. The gap 236 is selected to fragment oversize ore portions to produce sized ore portions. In general the rollers 232 and 234 are of heavier and more robust construction and provide greater fragmenting force than the sizing roller 114 and the opposing screening roller 108.

The operation of the apparatus 200 to produce a slurry of a bitumen ore feed is described with reference to FIG. 5. However, the apparatus 100 may also be used for sizing other ore feeds, and the resulting sized ore may be used as a feed for producing a slurry or for other processing operations.

The ore feed 208 is received from the transfer conveyor 210 and is discharged onto the slope sheet 206. The nozzle 219 is located to spray solvent onto the ore feed 208 to begin breaking down oversize portions. For a bitumen ore feed, the solvent provided through the conduit 220 may be heated water, which causes the bitumen portion to become less viscous thereby dissociating or partly dissolving bitumen clumps to aid in processing. Alternatively, the conduit 220 may be used to supply a solvent other than water to the nozzles 214, 216, 218, and 219. Advantageously, applying heated water to the ore feed 208 along the slope sheet 212 allows more time for the heated water combine with and to begin dissolving the bitumen clumps.

Ore portions of the ore feed 208 that strike the batter board 212 may be sidewardly directed to provide an ore feed at the inlet 118 that is uniformly distributed across the roller 112.

The nozzles 218 and 216 are operated to spray heated water at the ore feed 208 while in transit over the rollers 112 and 110. The ore feed 208 may include portions already of a nominal size and/or the action of the heated water may cause clumps to break down into nominally sized ore portions, which are able to pass through the interstices 150 (shown in FIG. 2) to produce a first sized ore portion 222. Referring back to FIG. 2, the configuration of the screening rollers 104-112, static plates 126 and 128, and the first and second end walls 122 and 124 provides a general uniform interstitial spacing over the area of the apparatus 100. The uniform interstitial spacing allows ore portions of a desired nominal size to pass through the screen into the slurry vessel 202. The heated water supplied through the nozzles 216 and 218 also helps prevent blockage of the apparatus 100 due to buildup of bitumen in the interstices 150.

Oversize ore portions are unable to pass through the interstices 150 and remain on top of the roller screen and are transported along the adjacent rollers 112, 110, and to roller 108 by the rotation of the rollers in the direction indicated by the arrows in FIG. 5. The engagement features on the rollers assist in transporting the ore along the roller screen 102 away from the inlet 118 and may also assist in breaking up clumps of ore in transit. While the oversize ore portions are being transported, the action of the hot water provided by the nozzles 216 and 218 and the tumbling action of the rollers 112, 110, and 108 may cause clumps to break off the oversize ore portions, thus reducing the size of the oversize portions and producing further sized ore portions that are able to pass through the interstices 150.

Rotation of the roller 108 then causes oversize ore portions (and some sized ore portions that are incorporated in between oversize ore portions) to be fed between the sizing roller 114 and the opposing screening roller 108. In the case of a bitumen ore feed, the oversize portions may include sand and/or rock clumped together by viscous bitumen that is fragmented by the action of the sizing roller 114. The configuration and spacing of the rollers 114 and 108 is selected to cause oversize ore portions to be broken up into ore portions of a desired nominal size, which are able to pass through the interstices between the adjacent screening rollers 106 and 108, or 104 and 106 to produce second sized ore portion 240. Referring back to FIG. 4, in the embodiment shown the hooked engagement features 194 operate to engage oversize ore portions and force the engaged ore against the surface of the roller 108, thereby sizing the ore feed.

Referring again to FIG. 5, the nozzle 214 sprays hot water on the ore that passes between the rollers 114 and 108 to further aid in breaking down the ore. In one embodiment the nozzles 214, 216 and 218 are arranged along an entire length of the roller screen 102 such that heated water or solvent is sprayed onto the ore feed 208 as the ore feed moves along the roller screen 102 from the inlet 118 to the outlet 140, which provides a feed to the comminutor 230.

Advantageously, the provision of the sizing roller 114 provides more active breaking up of oversize or portions in the ore feed 208 than is provided by the rolling or tumbling action of the adjacent rollers 104-112, thereby sizing a greater portion of the ore feed and reducing discharge of oversize ore portions from the roller 104.

The ore feed 208 may also include unbreakable oversize ore portions such as granite, for example. Accordingly, the frame 130 is configured to pivot about the pivot wheel 131, as described earlier, to permit passage of such ore portions. Unbreakable ore portions discharged from the sizing roller screen are received at the comminutor 230 and fragmented between the rollers 232 and 234 to produce a third sized ore portion 242. Advantageously, providing the comminutor 230 for fragmenting the remaining ore portion obviates the need to deal with discarded ore, but in other embodiments the comminutor 230 may be omitted and unbreakable ore portions may be discarded or transported away from the slurry apparatus 200 by a conveyor (not shown).

In operation of the apparatus 100 shown in FIG. 1, each of the rollers 104-112 and 114 are independently driven by a motor 120 and the speed of each roller may be varied in response to the constitution of the ore feed 208 and to increase or reduce the working time at any of the interfaces between adjacent rollers. In other embodiments a single drive motor may be mechanically coupled to drive more than one of the rollers 104-112 and 114.

The first, second and third sized ore portions 222, 240 and 242, together with the hot water added by the nozzles 214, 216, and 218 accumulate in the slurry vessel 202. Further heated water may be added through the inlet 203 to produce a slurry 244. The decreasing cross-sectional area of the slurry vessel 202 proximate the outlet 205 causes the slurry to be discharged through the outlet by forces of gravity. The outlet 205 may be in communication with a pump (not shown) for pumping the slurry along a pipeline (also not shown) for transport to apparatus where further processing of the slurry occurs. In general the addition of water is controlled to produce a slurry having a desired solids to water ratio for transport in a pipeline.

Figure 6:
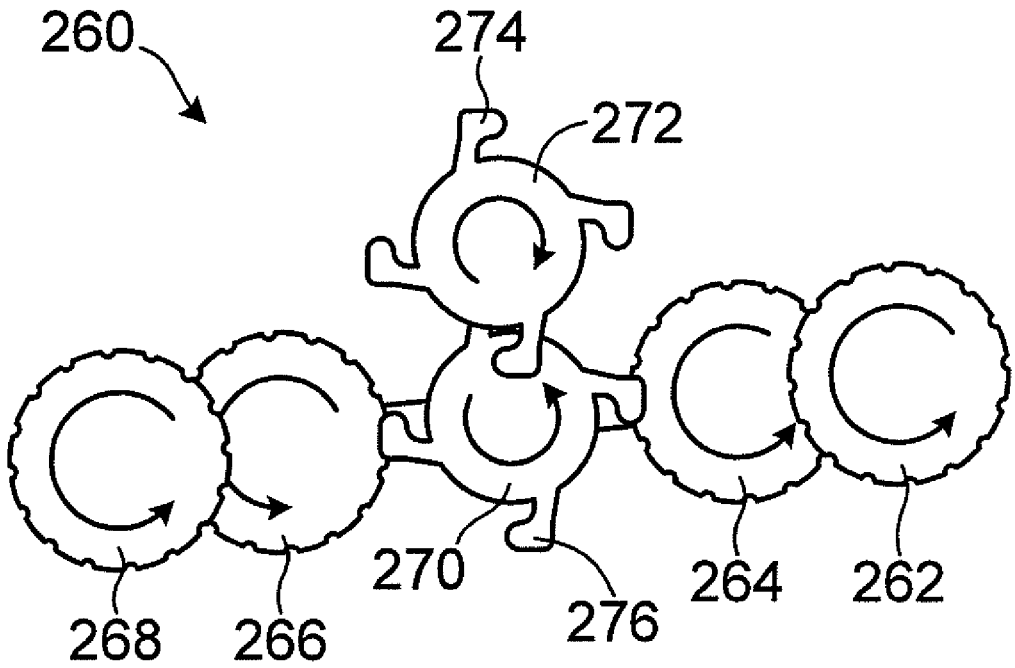
FIG. 6 is a schematic view of an alternative roller configuration for the apparatus shown in FIG. 1.

Referring to FIG. 6, an alternative arrangement of rollers for implementing the apparatus in accordance with another embodiment of the invention is shown in FIG. 1 generally at 260. In this embodiment, a plurality of screening rollers 262, 264, 270, 266, and 268 are disposed generally as shown in FIG. 1. A sizing roller 272 is disposed above the roller 270, which acts as the opposing screening roller. The sizing roller 272 includes hooked engagement features 274 for engaging the oversize ore portions. In this embodiment, the opposing screening roller 270 also includes hooked engagement features 276 that intermesh with the engagement features 274 on the sizing roller 272. Advantageously, the engagement features 274 and 276 cooperate to engage and fragment oversize ore portions to produce sized ore portions. Already sized ore portions in the ore feed received at the roller 262 may pass through interstices between the rollers 262 and 264, or 264 and 270, as described above.

The above embodiments have been described with reference to a roller screen having five adjacent rollers. However, depending on the ore feed and the desired nominal passing size, more or fewer rollers may be used to implement the apparatus.

While specific embodiments of the invention have been described and illustrated, such embodiments should be considered illustrative of the invention only and not as limiting the invention as construed in accordance with the accompanying claims.

What is claimed is:

1. A sizing roller screen apparatus for processing an ore feed received at an inlet, the ore feed including sized ore portions and oversize ore portions, the apparatus comprising:

a roller screen having a plurality of adjacent screening rollers extending away from the inlet and supported to provide interstices therebetween for permitting passage of the sized ore portions between the adjacent screening rollers, the adjacent screening rollers being operably configured to rotate to cause a first sized ore portion to pass through the interstices while the ore feed is being transported along the roller screen away from the inlet; and a sizing roller disposed generally above an opposing one of the plurality of adjacent screening rollers, the sizing roller being operably configured to rotate to fragment at least some of the oversize ore portions that are transported along the roller screen and pass between the sizing roller and the opposing screening roller to produce a second sized ore portion, the second sized ore portion being sized for passage through the interstices.

2. The apparatus of claim 1 wherein at least some of the screening rollers comprise a plurality of spaced apart generally circular plates supported on a shaft, the plates arranged along the shaft to intermesh with spaced apart plates of an adjacent screening roller to provide the interstices.

3. The apparatus of claim 2 wherein the sizing roller comprises a plurality of generally circular spaced apart plates supported on a shaft, the plates arranged along the shaft to intermesh with spaced apart plates of the opposing screening roller.

4. The apparatus of claim 3 wherein the opposing screening roller is spaced apart from the adjacent screening rollers and wherein the roller screen further comprises a plurality of static plates extending between the opposing screening roller and an adjacent screening roller and intermeshing therewith, the static plates being sufficiently spaced apart to permit the sized ore portions to pass between the static plates.

5. The apparatus of claim 1 wherein the sizing roller defines an outer working surface that is sufficiently spaced apart from an outer working surface of the opposing screening roller to permit at least some of the oversized ore portions to be fragmented to produce the second sized ore portion.

6. The apparatus of claim 5 wherein the outer working surface of the sizing roller comprises a wear resistant overlay for reducing abrasion of the sizing roller by the ore feed.

7. The apparatus of claim 5 wherein the outer working surface of the sizing roller is spaced apart from the outer working surface of the opposing screening roller in proportion to a spacing between outer working surfaces of the plurality of adjacent screening rollers.

8. The apparatus of claim 5 wherein the outer working surface of the sizing roller is spaced apart from the outer working surface of the opposing screening roller by about 50 mm to about 60 mm.

9. The apparatus of claim 5 wherein the outer working surface of the sizing roller comprises first engagement means for engaging the oversized ore portion and forcing the oversized ore portion against the outer working surface of the one of the plurality of adjacent screening rollers to cause the oversized ore portion to be fragmented to produce the second sized ore portion.

10. The apparatus of claim 9 wherein the outer working surface of the opposing screening roller comprises second engagement means for engaging the oversized ore portion and forcing the oversized ore portion against the outer working surface of the sizing roller to cause the oversized ore portion to be fragmented to produce the second sized ore portion.

11. The apparatus of claim 10 wherein the first engagement means and the second engagement means comprise respective first and second engagement features that intermesh with each other to fragment the oversized ore portion.

12. The apparatus of claim 1 wherein the sizing roller comprises a compliant mounting operably configured to permit the sizing roller to be displaced away from the opposing screening roller when oversize ore that resists fragmentation is passed between the sizing roller and the opposing screening roller.

13. The apparatus of claim 12 wherein the adjacent screening rollers are supported in a first frame and the sizing roller is mounted in a second frame disposed above the first frame, and wherein the compliant mounting comprises a pivot between the first and second frames, the pivot being operably configured to permit the second frame to displace away from the opposing screening roller.

14. The apparatus of claim 1 wherein the roller screen comprises a discharge outlet located distally along the roller screen from the inlet, the outlet being operably configured to discharge the oversize ore that resists fragmentation.

15. The apparatus of claim 14 further comprising a comminutor located to receive the oversize ore from the outlet, the comminutor being operably configured to fragment the oversize ore to provide a third sized ore portion.

16. The apparatus of claim 1 further comprising a variable speed drive coupled to each of the adjacent screening rollers and the sizing roller, the variable speed drive being operable to permit configuration of respective rotational speeds of each of the rollers for processing the ore feed.

17. The apparatus of claim 1 wherein the ore feed comprises a bitumen portion, and further comprising at least one nozzle disposed to spray heated water onto the ore feed to cause the bitumen portion to become less viscous thereby aiding in the processing of the ore feed.

18. The apparatus of claim 17 wherein the at least one nozzle comprises a plurality of nozzles located along an entire length of the roller screen and operably configured to spray heated water onto the ore feed as the ore feed moves along the roller screen.

19. The apparatus of claim 1 wherein the roller screen is disposed above a slurry vessel operable to produce a bitumen ore slurry of the sized ore that passes through the roller screen.

20. The apparatus of claim 1 wherein the opposing screening roller comprises a generally centrally located one of the plurality of adjacent screening rollers.

21. The apparatus of claim 1 wherein the plurality of adjacent screening rollers comprise first, second, third, fourth and fifth adjacent screening rollers, and the opposing screening roller is the third adjacent roller.

22. A sizing roller screen apparatus for processing an ore feed received at an inlet, the ore feed comprising a bitumen portion and including sized ore portions and oversize ore portions, the apparatus comprising:

a roller screen having a plurality of adjacent screening rollers supported to provide interstices therebetween for permitting passage of the sized ore portions between the adjacent screening rollers, the adjacent screening rollers being operably configured to rotate to cause a first sized ore portion to pass through the interstices while the ore feed is being transported along the roller screen;

a sizing roller disposed generally above an opposing one of the plurality of adjacent screening rollers, the sizing roller being operably configured to rotate to fragment at least some of the oversize ore portions passing between the sizing roller and the opposing screening roller to produce a second sized ore portion, the second sized ore portion being sized for passage through the interstices; and at least one nozzle disposed to spray heated water onto the ore feed to cause the bitumen portion to become less viscous thereby aiding in the processing the ore feed.

23. The apparatus of claim 22 wherein the at least one nozzle comprises a plurality of nozzles located along an entire length of the roller screen and operably configured to spray heated water onto the ore feed as the ore feed moves along the roller screen.

* * * * *